US012372277B2

(12) United States Patent
Pasarkar et al.

(10) Patent No.: US 12,372,277 B2
(45) Date of Patent: Jul. 29, 2025

(54) METHOD FOR CONTROLLING REFRIGERANT LIQUID FLOOD-BACK WITHIN A CHILLER AND A SYSTEM THEREOF

(71) Applicant: Blue Star Limited, Mumbai (IN)

(72) Inventors: Sandeep Pasarkar, Thane West (IN); Harshavardhan Kothavale, Thane West (IN)

(73) Assignee: Blue Star Limited, Mumbai (IN)

( * ) Notice: Subject to any disclaimer, the term of this patent is extended or adjusted under 35 U.S.C. 154(b) by 218 days.

(21) Appl. No.: 18/129,978

(22) Filed: Apr. 3, 2023

(65) Prior Publication Data

US 2023/0349603 A1 Nov. 2, 2023

(30) Foreign Application Priority Data

Apr. 4, 2022 (IN) ..... 202221020324

(51) Int. Cl.
*F25B 31/00* (2006.01)
*F25B 43/02* (2006.01)
*F25B 49/02* (2006.01)

(52) U.S. Cl.
CPC ..... *F25B 31/004* (2013.01); *F25B 43/02* (2013.01); *F25B 49/02* (2013.01); *F25B 2700/21151* (2013.01); *F25B 2700/21152* (2013.01)

(58) Field of Classification Search
CPC .. F25B 2700/21151; F25B 2700/21152; F25B 31/004; F25B 43/006; F25B 43/02; F25B 49/02
See application file for complete search history.

(56) References Cited

U.S. PATENT DOCUMENTS 6,374,629 B1 * 4/2002 Oberle ..... C10M 171/008 62/502
2012/0137723 A1 * 6/2012 Cho ..... F04B 39/02 62/468
2015/0308878 A1 * 10/2015 Pech ..... G01K 13/00 73/292
2021/0285693 A1 * 9/2021 Gerson ..... F25B 31/004

* cited by examiner

*Primary Examiner* — Henry T Crenshaw
(74) *Attorney, Agent, or Firm* — Forge IP, PLLC

(57) ABSTRACT

A refrigeration system includes a pump to deliver oil to the scroll compressor collected from the condenser and the evaporator. The refrigeration system also includes a heat exchanger in thermal communication with the oil at high temperature in the oil separator. Oil collected from the condenser and the evaporator is passed through the heat exchanger to gain a heat energy. The refrigeration system further includes a controller to control an oil return solenoid valve to adjust flow of heated oil from the pump into the scroll compressor based on a suction super heat at inlet of the scroll compressor. The heated oil evaporates the low-pressure liquid refrigerant particles in a low-pressure vapor refrigerant to avoid a flood-back in the refrigeration system.

12 Claims, 6 Drawing Sheets

METHOD FOR CONTROLLING REFRIGERANT LIQUID FLOOD-BACK WITHIN A CHILLER AND A SYSTEM THEREOF

TECHNICAL FIELD OF THE INVENTION

The present invention relates to flooded type chiller control system and a method for controlling refrigerant liquid flood-back within a chiller thereof.

BACKGROUND OF THE INVENTION

Generally, a chiller is used to chill water in an evaporator. Chillers are classified majorly into two types namely air-cooled chillers and water-cooled chillers. The chiller water is passed through air handling units which conditions the air for use in a building, mall etc. An evaporator in a water chiller system, controls temperature of the water by heat exchange with a refrigerant. The refrigerant circulates throughout the chiller system by means of a refrigerant loop. In the refrigerant loop, the refrigerant leaves the evaporator and enters a compressor where pressure of the refrigerant is increased, changing its condensation point. Low refrigerant gas is compressed in the compressor into high pressure refrigerant vapour. The high-pressure refrigerant vapour then enters an oil separator where oil gets separated and is returned to the compressors. The high-pressure refrigerant vapour then enters a condenser where it is condensed from a vapor to a liquid refrigerant by heat exchange with a cooling medium, typically a second water system. The high-pressure refrigerant liquid from condenser is expanded by an expansion valve to low pressure refrigerant liquid. The low-pressure refrigerant liquid then enters an evaporator where heat exchange with water causes it to become low pressure refrigerant vapour and the cycle continues through the refrigerant loop.

Generally, compressors that are used in chiller systems have limitations that include less volumetric efficiency, high energy cost, valve losses, large number of moving parts, operational noise, more space requirement, and the like. Alternatively, due to its inherent properties, usage of a scroll compressor may address the conventional problems of compressors. However, such scroll compressor intending to solve problems of conventional compressors do not find an application in flooded type evaporator system for lack of sensitivity for liquid flood-back and resulting in failure of the compressor which ultimately causes failure to the chiller system.

Therefore, there is a need to provide a method and system to overcome one or more of the aforementioned problems.

SUMMARY OF THE INVENTION

In one aspect of the present invention, a method of operating a refrigeration system for a flooded-type chiller is provided. The method comprises step of compressing, by a scroll compressor, a refrigerant to a desired temperature and pressure. The method comprises step of calculating, by a controller, a discharge superheat temperature of the refrigerant based on a discharge temperature of the refrigerant at an exit of the scroll compressor and a saturated discharge temperature of the refrigerant. The method also comprises step of virtually calculating, by the controller, an oil level in the scroll compressor based on the calculated discharge superheat temperature of the refrigerant, a top shell temperature of the scroll compressor, and a bottom shell temperature of the scroll compressor. The method further comprises step of comparing, by the controller, the virtually calculated oil level in the scroll compressor with a predetermined threshold oil level. The method comprises step of opening, by the controller, an oil return solenoid valve for a predetermined time based on the virtually calculated oil level in the scroll compressor to adjust flow of oil into the scroll compressor along with the oil from the oil separator. The oil return solenoid valve supplies the oil collected from a condenser and an evaporator of the refrigeration system.

According to the present invention, the controller is configured to compare the virtually calculated oil level in the scroll compressor with a first threshold oil level. The controller opens the oil return solenoid valve for a first predetermined time if the virtually calculated oil level in the scroll compressor is less than the first threshold oil level. The controller opens the oil return solenoid valve for a second predetermined time if the virtually calculated oil level in the scroll compressor is more than the first threshold oil level. The controller is also configured to compare the virtually calculated oil level in the scroll compressor with a second threshold oil level after the opening of the oil return solenoid valve for the first predetermined time. The controller opens the oil return solenoid valve for the first predetermined time if the virtually calculated oil level in the scroll compressor is less than the second threshold oil level. The controller opens the oil return solenoid valve for the second predetermined time if the virtually calculated oil level in the scroll compressor is more than the second threshold oil level.

According to the present invention, the controller is configured to compare the virtually calculated oil level in the scroll compressor with a third threshold oil level. The controller stops the scroll compressor if the virtually calculated oil level in the scroll compressor is less than the third threshold oil level. The controller is also configured to calculate a suction superheat temperature of the refrigerant at an inlet of the scroll compressor based on a suction temperature of the refrigerant at an inlet of the scroll compressor and a saturated suction temperature of the refrigerant. The controller is further configured to compare the suction superheat temperature of the refrigerant with a first threshold suction superheat temperature. The controller operates the refrigeration system as per required load demand of the flooded-type chiller if the suction superheat temperature of the refrigerant is more than the first threshold suction superheat temperature. The controller is configured to calculate a suction superheat temperature correction of the refrigerant based on the suction superheat temperature of the refrigerant if the suction superheat temperature of the refrigerant is less than the first threshold suction superheat temperature. The controller is also configured to adjust an expansion valve of the refrigeration system to maintain a threshold level of the refrigerant in the scroll compressor based on the suction superheat temperature correction of the refrigerant. The controller calculates a corrected refrigerant level based on a calculated virtual refrigerant level and a calculated suction superheat temperature correction. The suction superheat temperature correction of the refrigerant is determined by the controller based on the calculated suction superheat temperature of the refrigerant. The controller is further configured to compare the suction superheat temperature of the refrigerant with a second threshold suction superheat temperature. The controller operates the refrigeration system as per required load demand of the flooded-type chiller if the suction superheat temperature of the refrigerant is less than the second threshold suction superheat temperature. The controller is configured to compare the discharge superheat temperature of the refrigerant with a first threshold discharge superheat temperature. The controller adjusts the expansion valve of the refrigeration system to maintain the threshold level of the refrigerant in the scroll compressor if the discharge superheat temperature of the refrigerant is more than the first threshold discharge superheat temperature. The controller is also configured to control a speed of the scroll compressor until the discharge superheat temperature of the refrigerant reaches a second threshold discharge superheat temperature. The controller is further configured to compare the discharge superheat temperature of the refrigerant with the second threshold discharge superheat temperature. The controller operates the refrigeration system as per required load demand of the flooded-type chiller if the discharge superheat temperature of the refrigerant is more than the second threshold discharge superheat temperature. The controller controls the speed of the scroll compressor until the discharge superheat temperature of the refrigerant reaches the second threshold discharge superheat temperature if the discharge superheat temperature of the refrigerant is less than the second threshold discharge superheat temperature.

According to the present invention, the oil collected from the condenser and the evaporator is passed through a coil using a pump. The coil is in thermal communication with a hot oil in the oil separator to gain a heat energy.

According to the present invention, the hot oil evaporates a low-pressure liquid refrigerant particle in a low-pressure vapor refrigerant to avoid a flood-back in the refrigeration system.

In another aspect of the present invention, a refrigeration system for a flooded-type chiller is provided. The refrigeration system comprises a scroll compressor to compress a refrigerant to a desired temperature and pressure. The refrigeration system also comprises an oil separator to separate an oil from the refrigerant exiting from the scroll compressor. The refrigeration system further comprises a plurality of temperature sensors and a plurality of pressure sensors. The refrigeration system comprises a controller configured to calculate a discharge superheat temperature of the refrigerant based on a discharge temperature of the refrigerant at an exit of the scroll compressor and a saturated discharge temperature of the refrigerant. The controller is also configured to virtually calculate oil level in the scroll compressor based on the calculated discharge superheat temperature of the refrigerant, a top shell temperature of the scroll compressor, and a bottom shell temperature of the scroll compressor. The controller is further configured to compare the virtually calculated oil level in the scroll compressor with a predetermined threshold oil level. The controller is configured to open an oil return solenoid valve for a predetermined time based on the virtually calculated oil level in the scroll compressor to adjust flow of oil into the scroll compressor along with the oil from the oil separator. The oil return solenoid valve supplies the oil collected from a condenser and an evaporator of the refrigeration system.

According to the present invention, the controller is configured to compare the virtually calculated oil level in the scroll compressor with a first threshold oil level. The controller opens the oil return solenoid valve for a first predetermined time if the virtually calculated oil level in the scroll compressor is less than the first threshold oil level. The controller opens the oil return solenoid valve for a second predetermined time if the virtually calculated oil level in the scroll compressor is more than the first threshold oil level. The controller is also configured to compare the virtually calculated oil level in the scroll compressor with a second threshold oil level after the opening of the oil return solenoid valve for the first predetermined time. The controller opens the oil return solenoid valve for the first predetermined time if the virtually calculated oil level in the scroll compressor is less than the second threshold oil level. The controller opens the oil return solenoid valve for the second predetermined time if the virtually calculated oil level in the scroll compressor is more than the second threshold oil level.

According to the present invention, the controller is configured to compare the virtually calculated oil level in the scroll compressor with a third threshold oil level. The controller stops the scroll compressor if the virtually calculated oil level in the scroll compressor is less than the third threshold oil level. The controller is also configured to calculate a suction superheat temperature of the refrigerant at an inlet of the scroll compressor based on a suction temperature of the refrigerant at an inlet of the scroll compressor and a saturated suction temperature of the refrigerant. The controller is further configured to compare the suction superheat temperature of the refrigerant with a first threshold suction superheat temperature. The controller operates the refrigeration system as per required load demand of the flooded-type chiller if the suction superheat temperature of the refrigerant is more than the first threshold suction superheat temperature. The controller is configured to calculate a suction superheat temperature correction of the refrigerant based on the suction superheat temperature of the refrigerant if the suction superheat temperature of the refrigerant is less than the first threshold suction superheat temperature. The controller is also configured to adjust an expansion valve of the refrigeration system to maintain a threshold level of the refrigerant in the scroll compressor based on the suction superheat temperature correction of the refrigerant. The controller calculates a corrected refrigerant level based on a calculated virtual refrigerant level and a calculated suction superheat temperature correction. The suction superheat temperature correction of the refrigerant is determined by the controller based on the calculated suction superheat temperature of the refrigerant. The controller is further configured to compare the suction superheat temperature of the refrigerant with a second threshold suction superheat temperature. The controller operates the refrigeration system as per required load demand of the flooded-type chiller if the suction superheat temperature of the refrigerant is less than the second threshold suction superheat temperature. The controller is configured to compare the discharge superheat temperature of the refrigerant with a first threshold discharge superheat temperature. The controller adjusts the expansion valve of the refrigeration system to maintain the threshold level of the refrigerant in the scroll compressor if the discharge superheat temperature of the refrigerant is more than the first threshold discharge superheat temperature. The controller is also configured to control a speed of the scroll compressor until the discharge superheat temperature of the refrigerant reaches a second threshold discharge superheat temperature. The controller is further configured to compare the discharge superheat temperature of the refrigerant with the second threshold discharge superheat temperature. The controller operates the refrigeration system as per required load demand of the flooded-type chiller if the discharge superheat temperature of the refrigerant is more than the second threshold discharge superheat temperature. The controller controls the speed of the scroll compressor until the discharge superheat temperature of the refrigerant reaches the second threshold discharge superheat temperature if the discharge superheat temperature of the refrigerant is less than the second threshold discharge superheat temperature.

According to the present invention, the oil collected from the condenser and the evaporator is passed through a coil using a pump. The coil is in thermal communication with a hot oil in the oil separator to gain a heat energy.

According to the present invention, the hot oil evaporates a low-pressure liquid refrigerant particle in a low-pressure vapor refrigerant to avoid a flood-back in the refrigeration system.

According to the present invention, the temperature sensors have a scroll compressor inlet temperature sensor, a scroll compressor outlet temperature sensor, a condenser inlet temperature sensor, a condenser outlet temperature sensor, an oil return temperature sensor, an evaporator inlet temperature sensor, an evaporator outlet temperature sensor, a scroll compressor top shell temperature sensor, and a scroll compressor bottom shell temperature sensor.

According to the present invention, the pressure sensors have a scroll compressor inlet pressure transducer and a scroll compressor outlet pressure transducer.

BRIEF DESCRIPTION OF ACCOMPANYING DRAWING

The detailed description is described with reference to the accompanying figure.

It should be appreciated by those skilled in the art that any diagram herein represents conceptual views of illustrative system embodying the principles of the present disclosure.

DESCRIPTION OF THE INVENTION

Accordingly, the present invention relates to air and water cooled chiller with a flooded evaporator. The present invention discloses a scroll compressor chiller system with flooded type evaporator and fuzzy logic to avoid flood back and increase reliability of the system. The present invention avoids and controls refrigerant liquid flood-back in system.

Figure 1:
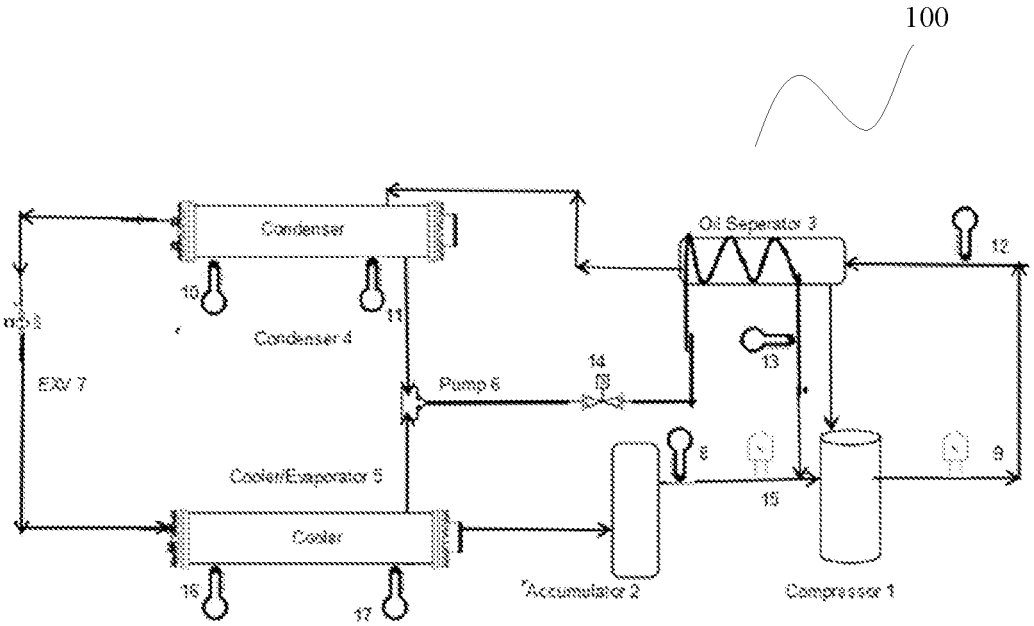
FIG. 1 shows a system for controlling refrigerant liquid flood-back within a chiller, according to an embodiment of the present invention.

Referring FIG. 1, according to an embodiment, illustrates a schematic diagram of a vapour compressor chiller system which comprises a series arrangement of a scroll compressor, a condenser, an electronic expansion valve, and an evaporator. The system includes an electric motor for the scroll compressor. The evaporator is shell and tube type evaporator with flooded type of system. The evaporator is heat exchanging medium and is utilize for the cooling load which may be the flow of water to and from. The refrigerant is on the shell side of the evaporator and water in on the tube side of the evaporator. A suction line connects the evaporator flooded type to the compressor passing vaporized refrigerant from the evaporator to the compressor, where the vapour is then compressed and discharged to condenser via a discharge line with non-return valve.

According to the embodiment, a chilling liquid, preferably water to be chilled is pumped into the chiller via an inlet line through the tubes where a temperature sensor 16 is located to measure the temperature of the inlet fluid and the chilled water discharges from the chiller via a discharge outlet line where a temperature sensor 17 is located measure the temperature of the outlet fluid. As the water flows through the tube, heat transfer from chilled water to the liquid refrigerant, causing the refrigerant to boil and vaporize. The low-pressure vapor refrigerant passes to the scroll compressor. This heat transfer causes the temperature of the chilling liquid flowing out of the chiller to be lower than the temperature of the chilling liquid flowing into the chiller.

According to the embodiment, the condenser in the present invention is a shell and tune type heat exchanger type, the condenser is a heat transfer vessel which condenses the compressed refrigerant vapour usually in shell side received from the scroll compressor. The heat of condensation is rejected to condensing water which enters the condenser through a line where the temperature sensor 11 is located and circulates through the tube contained in the shell and exist the condenser via a line were temperature sensor 10 is located.

According to the embodiment, the present invention includes a plurality of lines from condenser and the evaporator/cooler are connected to a pump 6 and from pump a line is connected to the compressor via an oil return solenoid valve 14. An oil return line passes through an oil separator 3 periphery to gain heat which ensures to evaporate liquid refrigerant migrated along with oil during evaporator oil return operation.

According to the embodiment, after condenser, the refrigerant enters the expansion valve inlet as a high-pressure liquid. The refrigerant flow is restricted by a metered orifice through which it must pass. As the refrigerant passes through this orifice, it changes from a high-pressure liquid to a low-pressure liquid.

According to the embodiment, a controller with predefined instructions is interfaced to various inputs like 9,15,12,14,8,10,11 etc. and provides continuous performance monitoring on a display.

According to the embodiment, the level of refrigerant is controlled in the evaporator/cooler in relation to a discharge super heat of the refrigerant. As the discharge super heat drops, a predefined set-point also drops. For example: If discharge super heat is of 20 deg c, then controller maintains level of refrigerant as rated value of 35% in cooler and if the discharge super heat is of 10 deg c, then then controller maintains level of refrigerant at a lower level as compared to the rated value. Further, the lower level of refrigerant depends upon the speed of the scroll compressor in case of inverter system.

According to the embodiment, the oil return solenoid valve 14 works as oil return valve. The oil return solenoid valve 14 will on/off through controller intermittently based on value of suction super heat. The suction super heat is calculated by said controller based on sensor input 13 and 15.

Figure 2:
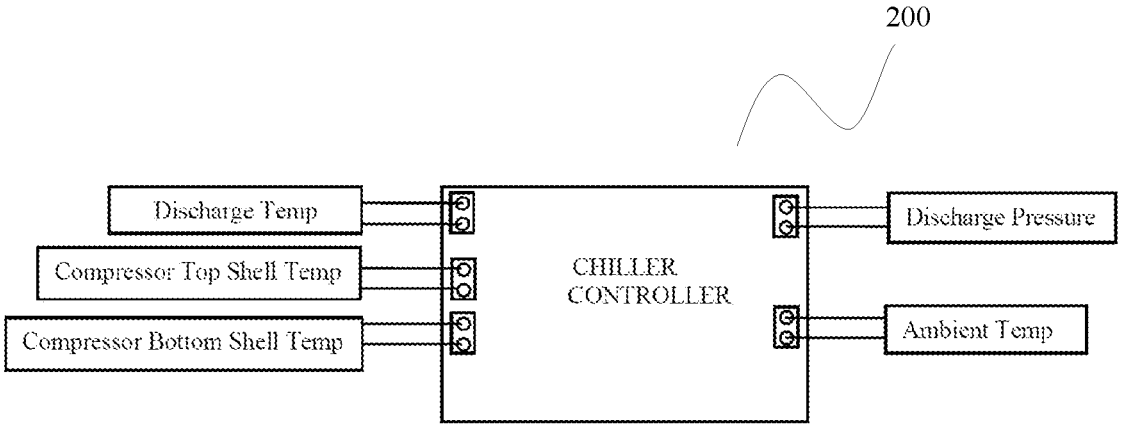
FIG. 2 shows a block diagram of a controller to detect oil level in a scroll compressor, according to the embodiment of the present invention.

Referring to FIG. 2, the level of oil in the scroll compressor is controlled by the controller. The controller identifies virtual level of oil inside the scroll compressor in a flooded scroll chiller. If the virtual level of oil falls below critical value, the controller switches off the compressor to save the compressor from mechanical damage.

According to the embodiment, the controller takes inputs from a plurality of sensor values that includes to determine compressor top shell temperature value, compressor bottom shell temperature value, discharge temperature value, discharge pressure value, ambient temperature value frequency of compressor and value percentage of electronic expansion valve open.

According to the embodiment, the controller then calculates pressure ratio value, calculated discharge temperature value, temperature difference between the top shell and the bottom shell temperature value, ambient correction value, percentage of electronic expansion valve open correction value, calculated discharge temperature, and calculated oil level. The oil level calculated will be from 0 to 100% where 0% indicates completely empty and 100% indicates completely full.

According to the embodiment, a flooded scroll chiller of the present invention includes the external oil separator and an oil pump system to manage and ensure enough oil inside the scroll compressor, thereby ensuring oil recovery and control.

According to the embodiment, the oil separator installed at the exit of the scroll compressor separates the oil from the refrigerant. The oil pump is used to return the excess oil from the evaporator and the condenser to the scroll compressor. The returning oil is injected into the suction line of the scroll compressor. However due to the very large pressure difference, some amount of liquid refrigerant also enters the oil return line/pump system and if not converted to vapour form will cause damage to the compressor. To prevent this, the oil pump system is routed through the oil separator where it will gain heat and convert into vapour form and then enter the suction line of the compressor. The opening and closing of the electronic expansion valve are controlled on the calculated refrigerant level.

Figure 3:
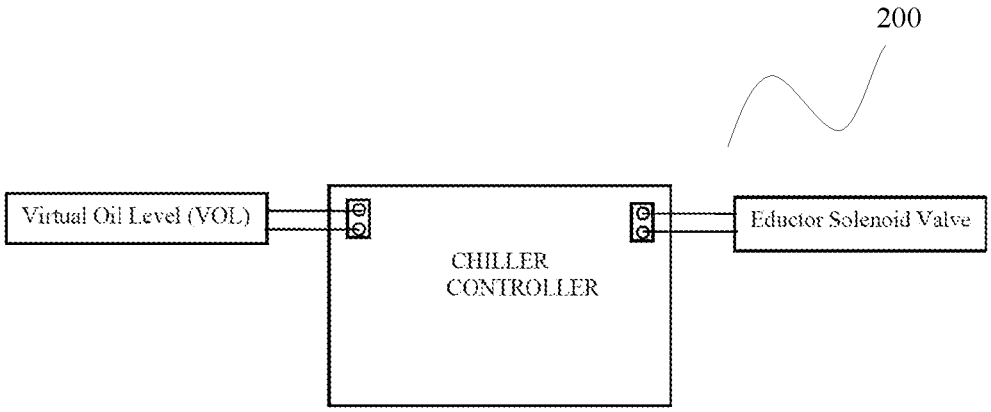
FIG. 3 shows a block diagram of controller for oil recovery and control, according to first embodiment of the present invention.
Figure 4:
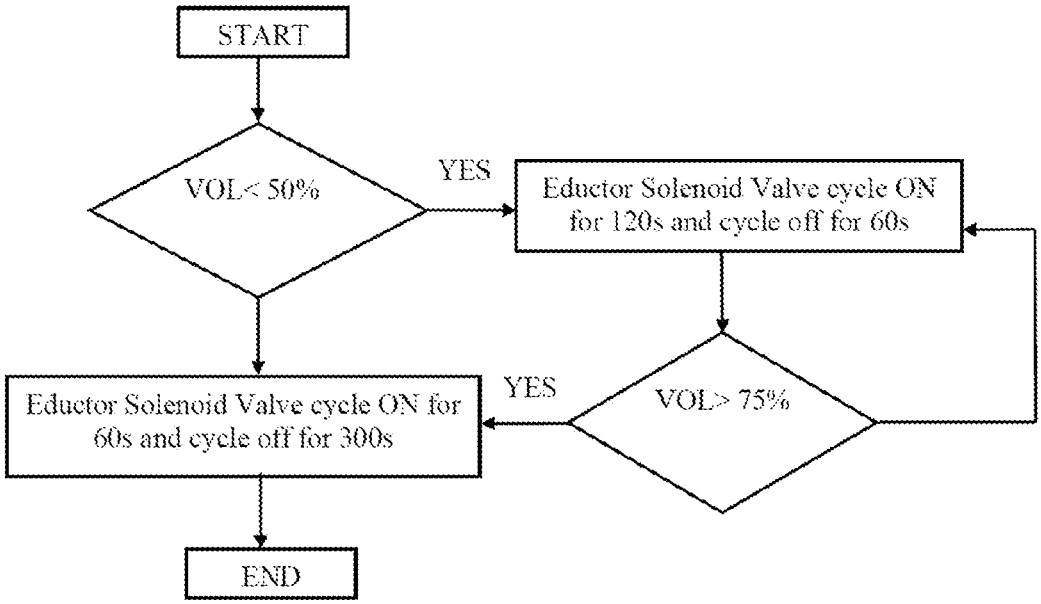
FIG. 4 shows a flow chart for oil recovery and control, according to first embodiment of the present invention.

Referring to FIGS. 3 and 4, according to first embodiment, the controller (200) compares the virtually calculated oil level in the scroll compressor with a first threshold oil level. In this embodiment, the first threshold oil level is 50%. The controller (200) opens the oil return solenoid valve (14) for a first predetermined time if the virtually calculated oil level in the scroll compressor (1) is less than the first threshold oil level. In this embodiment, the first predetermined time includes 120 seconds opening of the oil return solenoid valve (14) and 60 seconds closing of the oil return solenoid valve (14). The controller (200) opens the oil return solenoid valve (14) for a second predetermined time if the virtually calculated oil level in the scroll compressor (1) is more than the first threshold oil level. In this embodiment, the second predetermined time includes 60 seconds opening of the oil return solenoid valve (14) and 300 seconds closing of the oil return solenoid valve (14). The controller (200) compares the virtually calculated oil level in the scroll compressor (1) with a second threshold oil level after the opening of the oil return solenoid valve (14) for the first predetermined time. In this embodiment, the second threshold oil level is 75%. The controller (200) opens the oil return solenoid valve (14) for the first predetermined time if the virtually calculated oil level in the scroll compressor (1) is less than the second threshold oil level. The controller (200) opens the oil return solenoid valve (14) for the second predetermined time if the virtually calculated oil level in the scroll compressor (1) is more than the second threshold oil level. Therefore, if the virtually calculated oil level in the scroll compressor is less than the first threshold oil level, the oil return solenoid valve is opened by the controller for a predetermined time period to supply additional oil to the scroll compressor to avoid flood-back.

Figure 5:
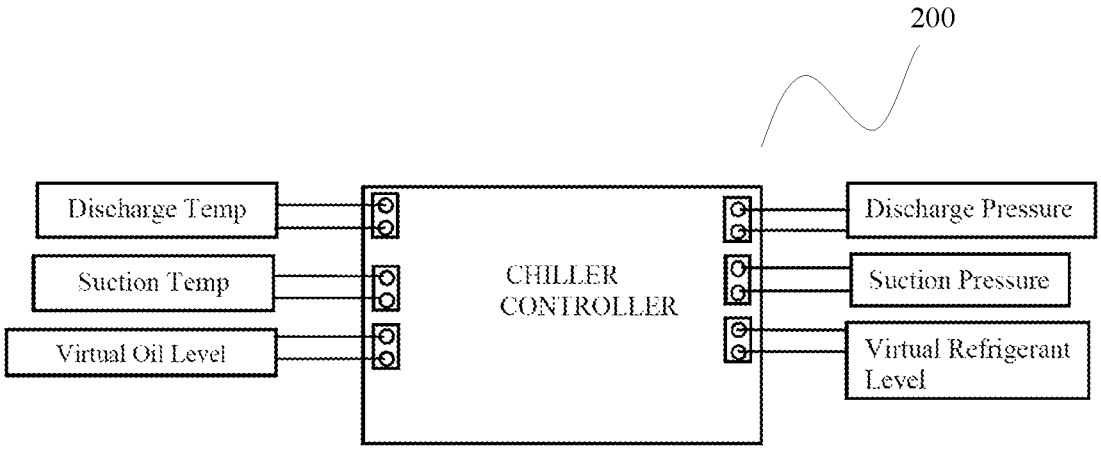
FIG. 5 shows a block diagram of controller for oil recovery and control, according to second embodiment of the present invention.
Figure 6:
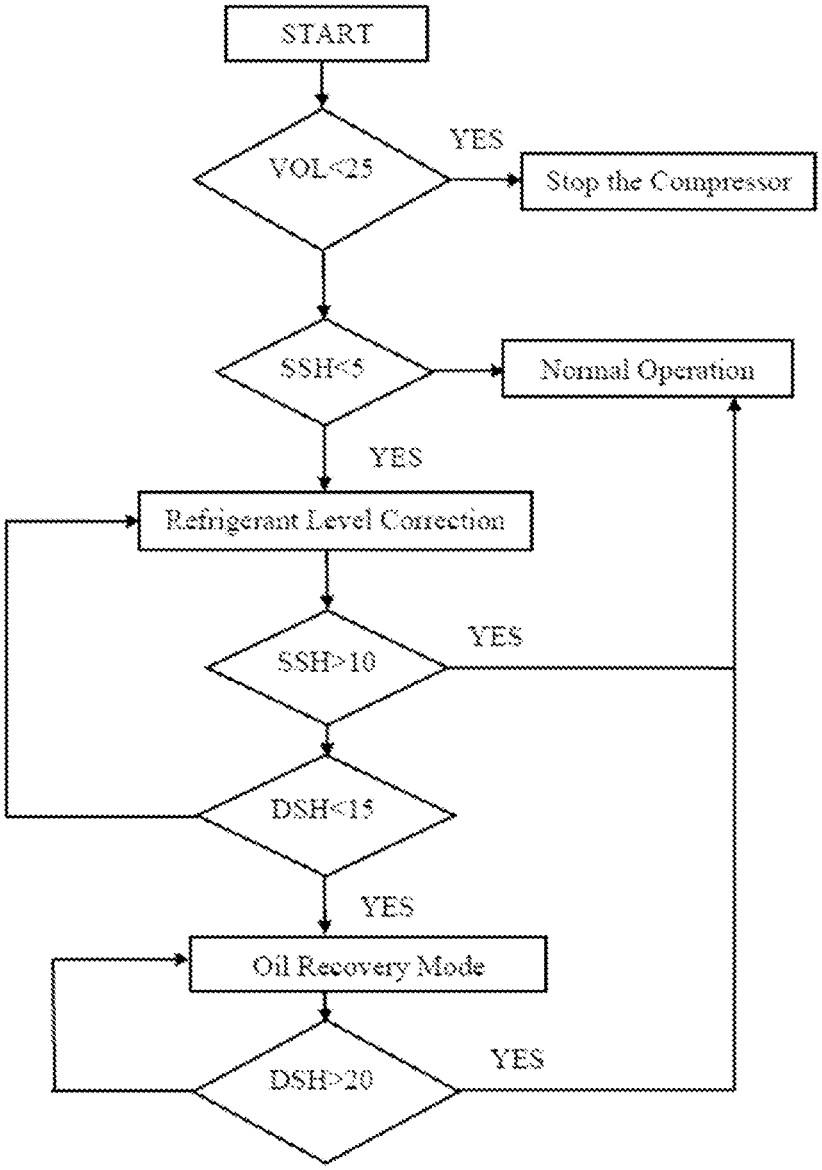
FIG. 6 shows a flow chart for oil recovery and control, according to second embodiment of the present invention.

Referring to FIGS. 5 and 6, according to second embodiment, the controller (200) is configured to compare the virtually calculated oil level in the scroll compressor (1) with a third threshold oil level. In this embodiment, the third threshold oil level is 25%. The controller (200) stops the scroll compressor (1) if the virtually calculated oil level in the scroll compressor (1) is less than the third threshold oil level. The controller (200) is also configured to calculate a suction superheat temperature of the refrigerant based on a suction temperature of the refrigerant at an inlet of the scroll compressor (1) and a saturated suction temperature of the refrigerant. The controller (200) is further configured to compare the suction superheat temperature of the refrigerant with a first threshold suction superheat temperature. In this embodiment, the first threshold suction superheat temperature is 5° C. The controller (200) operates the refrigeration system (100) as per required load demand of the flooded-type chiller if the suction superheat temperature of the refrigerant is more than the first threshold suction superheat temperature. The controller (200) is configured to calculate a suction superheat temperature correction of the refrigerant based on the suction superheat temperature of the refrigerant if the suction superheat temperature of the refrigerant is less than the first threshold suction superheat temperature. The controller (200) is configured to adjust an expansion valve (7) of the refrigeration system (100) to maintain a threshold level of the refrigerant in the scroll compressor (1) based on the suction superheat temperature correction of the refrigerant. The controller (200) calculates a corrected refrigerant level based on a calculated virtual refrigerant level and a calculated suction superheat temperature correction. The suction superheat temperature correction of the refrigerant is determined by the controller (200) based on the calculated suction superheat temperature of the refrigerant. The controller (200) is also configured to compare the suction superheat temperature of the refrigerant with a second threshold suction superheat temperature. In this embodiment, the second threshold suction superheat temperature is 10° C. The controller (200) operates the refrigeration system (100) as per required load demand of the flooded-type chiller if the suction superheat temperature of the refrigerant is less than the second threshold suction superheat temperature. The controller (200) is further configured to compare the discharge superheat temperature of the refrigerant with a first threshold discharge superheat temperature. In this embodiment, the first threshold discharge superheat temperature is 15° C. The controller (200) adjusts the expansion valve (7) of the refrigeration system (100) to maintain the threshold level of the refrigerant in the scroll compressor (1) if the discharge superheat temperature of the refrigerant is more than the first threshold discharge superheat temperature. The controller (200) is configured to control a speed of the scroll compressor (1) until the discharge superheat temperature of the refrigerant reaches a second threshold discharge superheat temperature. In this embodiment, the second threshold discharge superheat temperature is 20° C. The controller (200) is also configured to compare the discharge superheat temperature of the refrigerant with the second threshold discharge superheat temperature. The controller (200) operates the refrigeration system (100) as per required load demand of the flooded-type chiller if the discharge superheat temperature of the refrigerant is more than the second threshold discharge superheat temperature. The controller (200) controls the speed of the scroll compressor (1) until the discharge superheat temperature of the refrigerant reaches the second threshold discharge superheat temperature if the discharge superheat temperature of the refrigerant is less than the second threshold discharge superheat temperature.

Therefore, the oil return solenoid valve is opened by the controller for a predetermined time period to supply additional oil to the scroll compressor to avoid flood-back.

According to the embodiment, once the controller determines the above values, the controller calculates, suction superheat, discharge superheat, suction superheat correction. If the calculated oil level is less than a predetermined value, the controller invokes signals to stop the compressor and saves the compressor from damage. Based on above calculated values, controller regulates oil management in the compressor when predetermined conditions are met else, the normal operation of the system takes place.

According to the embodiment, the various modes of the system controlled by the controller as follows: In a normal mode operation, the chiller system runs as per demand and loading (increase in frequency) and unloading will take place according to chiller water out requirement. The electronic expansion valve will open and close to maintain the calculated refrigerant level inside the evaporator of the chiller. In a refrigerant level correction mode, the calculated refrigerant level will be corrected based on the suction superheat correction. The electronic expansion valve will now open and close to maintain this corrected value of refrigerant level. In an oil recovery mode, the compressor runs at the best oil return frequency, for example at 3900 rpm. The loading and unloading of compressor will not take place. This ensures that oil returns into the compressor whereby the increase in calculated discharge temperature indicates oil return into the compressor.

The terms and words used in the following description are not limited to the bibliographical meanings but are merely used by the inventor to enable a clear and consistent understanding of the invention. Accordingly, it should be apparent to those skilled in the art that the following description of flooded chiller system referred in the description for the purpose of the understanding and nowhere limit the invention and said system fuzzy logic disclosed in the present invention can be adapted to other system of like as well. Further, the figures are only for reference and understating the purpose of the invention and those do not have limitation effect in the present application.

There have been described and illustrated herein several embodiments of a scroll compressor chiller system. While particular embodiments of the invention have been described, it is not intended that the invention be limited thereto, as it is intended that the invention be as broad in scope as the art will allow and that the specification be read likewise. Thus, while particular type of controller, sensors, input values, temperatures, pressures, predetermined values, time intervals have been disclosed, it will be appreciated that the embodiments are not limited to those described herein and may vary accordingly as well. The structure and design of the system may vary accordingly as well.

Many modifications may be made without departing from the basic spirit of the present invention. Accordingly, it will be appreciated by those skilled in the art that the invention may be practiced other than has been specifically described herein.

The invention claimed is:

1. A method of operating a refrigeration system for a flooded-type chiller, the method comprising steps of:

compressing, by a scroll compressor, a refrigerant to a desired temperature and pressure;

separating, by an oil separator, an oil from the refrigerant exiting from the scroll compressor;

calculating, by a controller, a discharge superheat temperature of the refrigerant based on a discharge temperature of the refrigerant at an exit of the scroll compressor and a saturated discharge temperature of the refrigerant;

comparing, by the controller, an oil level in the scroll compressor virtually calculated by the controller with a predetermined threshold oil level; and opening, by the controller, an oil return solenoid valve for a predetermined time based on the virtually calculated oil level in the scroll compressor to adjust flow of oil into the scroll compressor along with the oil from the oil separator, the oil return solenoid valve supplies the oil collected from a condenser and an evaporator of the refrigeration system.

2. The method as claimed in claim 1, wherein the controller is configured to:

compare the virtually calculated oil level in the scroll compressor with a first threshold oil level, the controller opens the oil return solenoid valve for a first predetermined time if the virtually calculated oil level in the scroll compressor is less than the first threshold oil level, the controller opens the oil return solenoid valve for a second predetermined time if the virtually calculated oil level in the scroll compressor is more than the first threshold oil level; and compare the virtually calculated oil level in the scroll compressor with a second threshold oil level after the opening of the oil return solenoid valve for the first predetermined time, the controller opens the oil return solenoid valve for the first predetermined time if the virtually calculated oil level in the scroll compressor is less than the second threshold oil level, the controller opens the oil return solenoid valve for the second predetermined time if the virtually calculated oil level in the scroll compressor is more than the second threshold oil level.

3. The method as claimed in claim 1, wherein the controller is configured to:

compare the virtually calculated oil level in the scroll compressor with a third threshold oil level, the controller stops the scroll compressor if the virtually calculated oil level in the scroll compressor is less than the third threshold oil level;

calculate a suction superheat temperature of the refrigerant based on a suction temperature of the refrigerant at an inlet of the scroll compressor and a saturated suction temperature of the refrigerant;

compare the suction superheat temperature of the refrigerant with a first threshold suction superheat temperature, the controller operates the refrigeration system as per required load demand of the flooded-type chiller if the suction superheat temperature of the refrigerant is more than the first threshold suction superheat temperature;

adjust an expansion valve of the refrigeration system to maintain a threshold level of the refrigerant in the scroll compressor if the suction superheat temperature of the refrigerant is less than the first threshold suction superheat temperature, the controller calculates a corrected refrigerant level based on a calculated virtual refrigerant level and a calculated suction superheat temperature correction, the suction superheat temperature correction of the refrigerant is determined by the controller based on the calculated suction superheat temperature of the refrigerant;

compare the suction superheat temperature of the refrigerant with a second threshold suction superheat temperature, the controller operates the refrigeration system as per required load demand of the flooded-type chiller if the suction superheat temperature of the refrigerant is less than the second threshold suction superheat temperature;

compare the discharge superheat temperature of the refrigerant with a first threshold discharge superheat temperature, the controller adjusts the expansion valve of the refrigeration system to maintain the threshold level of the refrigerant in the scroll compressor if the discharge superheat temperature of the refrigerant is more than the first threshold discharge superheat temperature;

control a speed of the scroll compressor until the discharge superheat temperature of the refrigerant reaches a second threshold discharge superheat temperature; and compare the discharge superheat temperature of the refrigerant with the second threshold discharge superheat temperature, the controller operates the refrigeration system as per required load demand of the flooded-type chiller if the discharge superheat temperature of the refrigerant is more than the second threshold discharge superheat temperature, the controller controls the speed of the scroll compressor until the discharge superheat temperature of the refrigerant reaches the second threshold discharge superheat temperature if the discharge superheat temperature of the refrigerant is less than the second threshold discharge superheat temperature.

4. The method as claimed in claim 1, wherein the oil collected from the condenser and the evaporator is passed through a coil using a pump, the coil is in thermal communication with a hot oil in the oil separator to gain a heat energy.

5. The method as claimed in claim 4, wherein the hot oil evaporates a low-pressure liquid refrigerant particle in a low-pressure vapor refrigerant to avoid a flood-back in the refrigeration system.

6. A refrigeration system for a flooded-type chiller, the refrigeration system comprising:

a scroll compressor to compress a refrigerant to a desired temperature and pressure;

an oil separator to separate an oil from the refrigerant exiting from the scroll compressor;

a plurality of temperature sensors and a plurality of pressure sensors; and a controller configured to:

calculate a discharge superheat temperature of the refrigerant based on a discharge temperature of the refrigerant at an exit of the scroll compressor and a saturated discharge temperature of the refrigerant;

compare a virtually calculated oil level in the scroll compressor with a predetermined threshold oil level; and open an oil return solenoid valve for a predetermined time based on the virtually calculated oil level in the scroll compressor to adjust flow of oil into the scroll compressor along with the oil from the oil separator, the oil return solenoid valve supplies the oil collected from a condenser and an evaporator of the refrigeration system.

7. The refrigeration system as claimed in claim 6, wherein the controller is configured to:

compare the virtually calculated oil level in the scroll compressor with a first threshold oil level, the controller opens the oil return solenoid valve for a first predetermined time if the virtually calculated oil level in the scroll compressor is less than the first threshold oil level, the controller opens the oil return solenoid valve for a second predetermined time if the virtually calculated oil level in the scroll compressor is more than the first threshold oil level; and compare the virtually calculated oil level in the scroll compressor with a second threshold oil level after the opening of the oil return solenoid valve for the first predetermined time, the controller opens the oil return solenoid valve for the first predetermined time if the virtually calculated oil level in the scroll compressor is less than the second threshold oil level, the controller opens the oil return solenoid valve for the second predetermined time if the virtually calculated oil level in the scroll compressor is more than the second threshold oil level.

8. The refrigeration system as claimed in claim 6, wherein the controller is configured to:

compare the virtually calculated oil level in the scroll compressor with a third threshold oil level, the controller stops the scroll compressor if the virtually calculated oil level in the scroll compressor is less than the third threshold oil level;

calculate a suction superheat temperature of the refrigerant based on a suction temperature of the refrigerant at an inlet of the scroll compressor and a saturated suction temperature of the refrigerant;

compare the suction superheat temperature of the refrigerant with a first threshold suction superheat temperature, the controller operates the refrigeration system as per required load demand of the flooded-type chiller if the suction superheat temperature of the refrigerant is more than the first threshold suction superheat temperature;

adjust an expansion valve of the refrigeration system to maintain a threshold level of the refrigerant in the scroll compressor if the suction superheat temperature of the refrigerant is less than the first threshold suction superheat temperature, the controller calculates a corrected refrigerant level based on a calculated virtual refrigerant level and a calculated suction superheat temperature correction, the suction superheat temperature correction of the refrigerant is determined by the controller based on the calculated suction superheat temperature of the refrigerant;

compare the suction superheat temperature of the refrigerant with a second threshold suction superheat temperature, the controller operates the refrigeration system as per required load demand of the flooded-type chiller if the suction superheat temperature of the refrigerant is less than the second threshold suction superheat temperature;

compare the discharge superheat temperature of the refrigerant with a first threshold discharge superheat temperature, the controller adjusts the expansion valve of the refrigeration system to maintain the threshold level of the refrigerant in the scroll compressor if the discharge superheat temperature of the refrigerant is more than the first threshold discharge superheat temperature;

control a speed of the scroll compressor until the discharge superheat temperature of the refrigerant reaches a second threshold discharge superheat temperature; and compare the discharge superheat temperature of the refrigerant with the second threshold discharge superheat temperature, the controller operates the refrigeration system as per required load demand of the flooded-type chiller if the discharge superheat temperature of the refrigerant is more than the second threshold discharge superheat temperature, the controller controls the speed of the scroll compressor until the discharge superheat temperature of the refrigerant reaches the second threshold discharge superheat temperature if the discharge superheat temperature of the refrigerant is less than the second threshold discharge superheat temperature.

9. The refrigeration system as claimed in claim 6, wherein the oil collected from the condenser and the evaporator is passed through a coil using a pump, the coil is in thermal communication with a hot oil in the oil separator to gain a heat energy.

10. The refrigeration system as claimed in claim 9, wherein the hot oil evaporates a low-pressure liquid refrigerant particle in a low-pressure vapor refrigerant to avoid a flood-back in the refrigeration system.

11. The refrigeration system as claimed in claim 6, wherein the temperature sensors have a scroll compressor inlet temperature sensor, a scroll compressor outlet temperature sensor, a condenser inlet temperature sensor, a condenser outlet temperature sensor, an oil return temperature sensor, an evaporator inlet temperature sensor, an evaporator outlet temperature sensor, a scroll compressor top shell temperature sensor, and a scroll compressor bottom shell temperature sensor.

12. The refrigeration system as claimed in claim 6, wherein the pressure sensors have a scroll compressor inlet pressure transducer and a scroll compressor outlet pressure transducer.

* * * * *